US006375444B1

(12) United States Patent
Dewar

(10) Patent No.: US 6,375,444 B1
(45) Date of Patent: Apr. 23, 2002

(54) AXIAL PRESSURE SEAL LUBRICATOR

(75) Inventor: Todd W. Dewar, Abingdon, VA (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 09/783,456

(22) Filed: Feb. 14, 2001

(51) Int. Cl.[7] ..... F03C 2/00

(52) U.S. Cl. ..... 418/99; 418/55.4; 418/55.5; 418/55.6; 418/57; 418/94; 418/15; 184/6.18

(58) Field of Search ..... 418/99, 94, 55.5, 418/55.7, 55.6, 55.4; 184/6.18

(56) References Cited

U.S. PATENT DOCUMENTS

| | | | | |
|---|---|---|---|---|
| 5,989,000 A | * | 11/1999 | Tomayko et al. | 418/55.5 |
| 6,149,413 A | | 11/2000 | Lifson | |

FOREIGN PATENT DOCUMENTS

| | | | | |
|---|---|---|---|---|
| JP | 55-160192 | * | 12/1980 | 418/55.6 |
| JP | 61-192881 | * | 8/1986 | 418/55.6 |
| JP | 01-277694 | * | 11/1989 | 418/55.6 |
| JP | 03-145589 | * | 6/1991 | 418/55.6 |
| JP | 04-041987 | * | 2/1992 | 418/55.6 |
| JP | 04-203380 | * | 7/1992 | 418/55.6 |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor has a unique oil supply port for supplying lubricant to both the seals and the Oldham coupling. The oil supply port is positioned at a location such that it will not likely result in undue amounts of lubricant being entrained into the refrigerant leading into the compression chambers. The present invention is thus an improvement over the prior art.

7 Claims, 2 Drawing Sheets

Fig-2
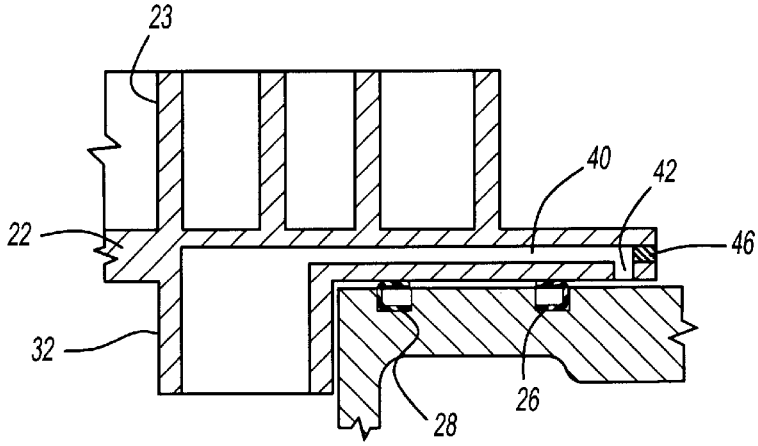
Fig-3
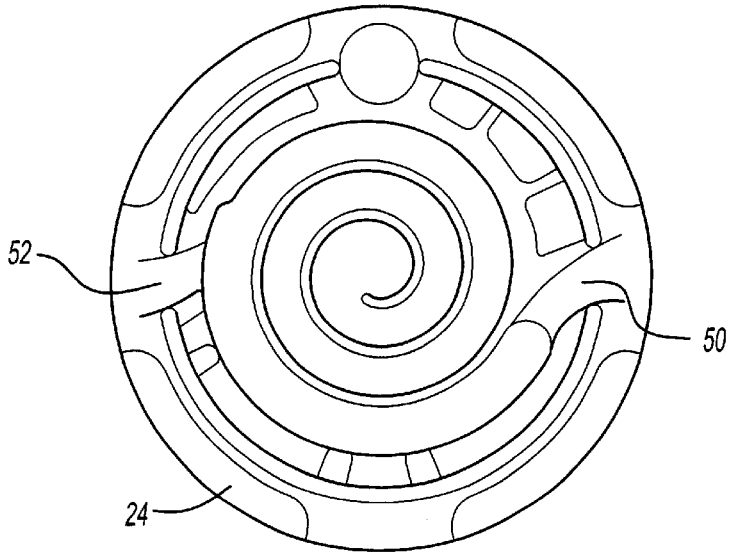
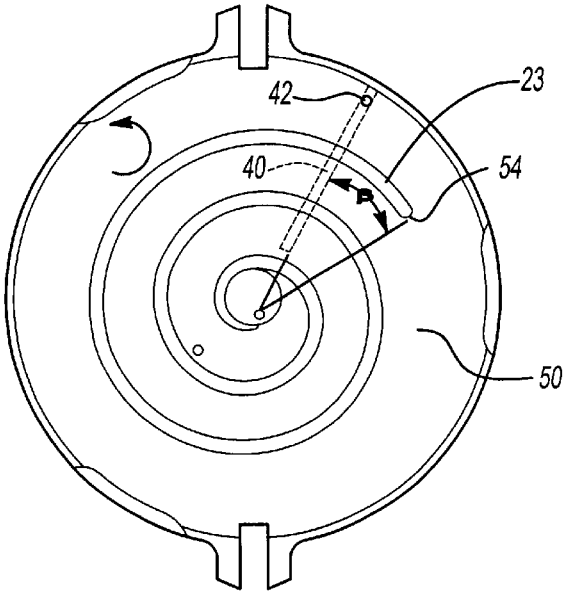
Fig-4

AXIAL PRESSURE SEAL LUBRICATOR

BACKGROUND OF THE INVENTION

This invention relates to a unique positioning of an axial oil supply port for a scroll compressor.

Scroll compressors are becoming widely utilized in refrigerant compression applications. In a scroll compressor, a pair of interfitting scroll members each have a base and a generally spiral wrap extending from the base. The wraps interfit to define compression chambers. One of the two scroll members is caused to orbit relative to the other, and the interfitting wraps define compression chambers As the orbiting scroll orbits the size of the compression chambers decrease and an entrapped refrigerant is compressed.

One challenge to a scroll compressor designer is that the entrapped refrigerant creates a force tending to separate the two scroll members. In response to this "separating force" a portion of the refrigerant is tapped from a compression chamber to a back pressure chamber behind the orbiting scroll. This entrapped refrigerant creates a force tending to resist the separating force. A pair of seals are positioned within a crankcase which supports the orbiting scroll to define the back pressure chamber. Further, a coupling is typically positioned radially outwardly of the seals to constrain the orbiting scroll for orbital movement.

It is desirable to supply lubricant both to the seals and to the coupling. In the past, oil is supplied through the driveshaft into a cross-hole extending through the orbiting scroll. This oil is then delivered to a location between the seals and the coupling. In the past this oil has been delivered at a location upstream of the beginning of the orbiting scroll wrap. It is desirable that this oil not be supplied at a location where it is likely to flow into the compression chambers in undue amounts. Thus, it would be desirable to position the cross-hole at a location such that it is unlikely the oil will flow into the scroll compressor.

SUMMARY OF THE INVENTION

In the disclosed embodiment of this invention, a hole for supplying oil to a downwardly extending supply hole is positioned between 25° and 90° from the beginning of the orbiting scroll wrap. More preferably, this hole is positioned 30°.

With this positioning, the lubricant will be adequately supplied, but will not be likely to flow into the compression chambers in any undue amount.

More preferably, the present invention incorporates a scroll compressor wherein there are two refrigerant supply ports spaced by approximately 180°. Thus, the positioning of the supply port downstream of the beginning of the scroll wrap by a limited angular amount will ensure that that oil will not flow in undue amounts into the compression chamber through either of the suction ports. Again, this provides benefits.

These and other features of the present invention can be best understood from the following specification and drawings, the following of which is a brief description.

BRIEF DESCRIPTION OF THE DRAWINGS

FIG. 2 is a cross-sectional view through the scroll compressor according to this invention.

FIG. 3 is a plan view of the non-orbiting scroll of this invention.

FIG. 4 is a plan view of the orbiting scroll of the present invention.

DETAILED DESCRIPTION OF A PREFERRED EMBODIMENT

Figure 1:
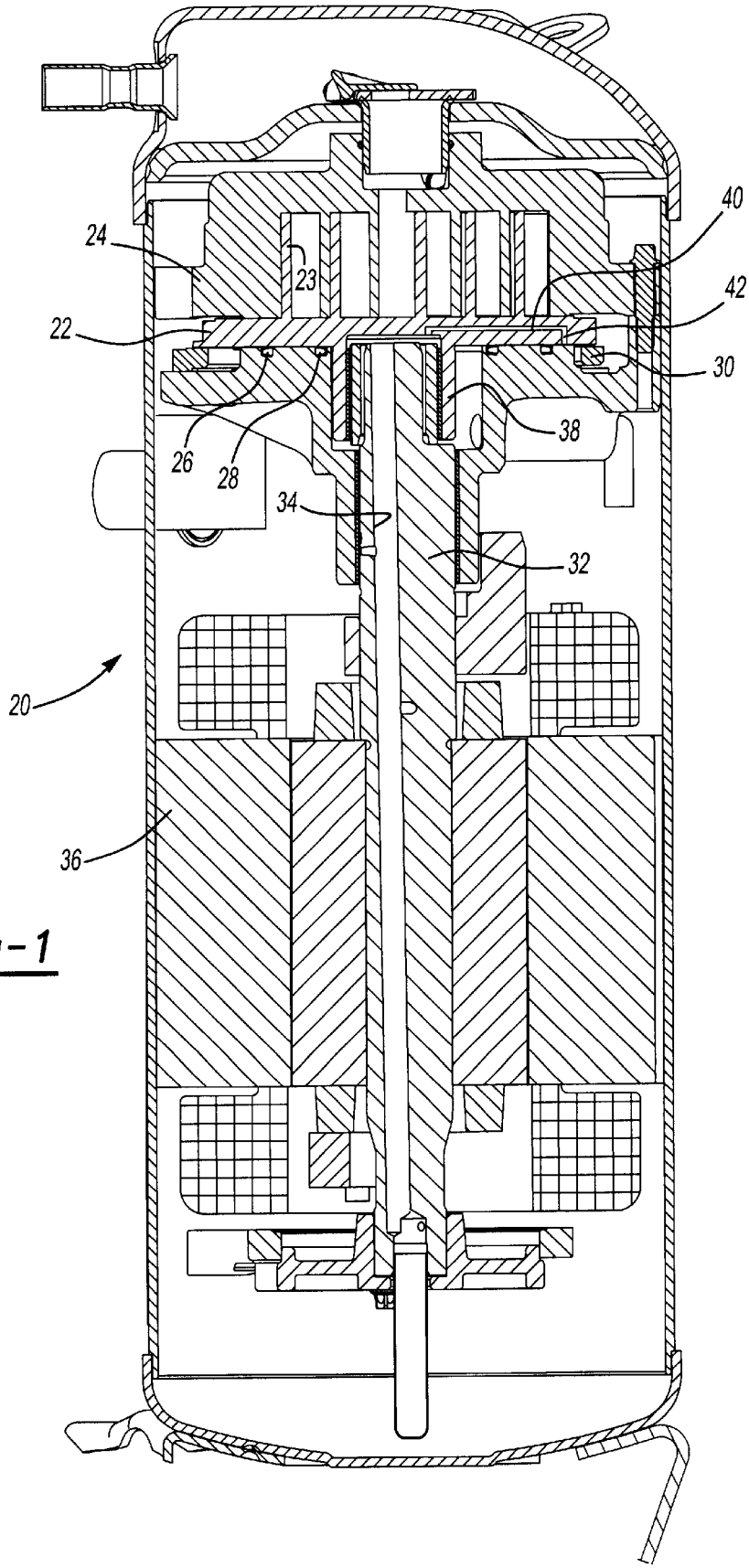
FIG. 1 is a cross-sectional view of a scroll compressor incorporating this invention.

A scroll compressor 20 is illustrated in FIG. 1 incorporating an orbiting scroll 22 having a generally spiral wrap 23. The orbiting scroll 22 interfits with a non-orbiting scroll 24, as known. A radially outer seal 26 and a radially inner seal 28 define a back pressure chamber, as known. An Oldham coupling 30 constrains the orbiting scroll 22 for orbital movement. An input shaft 32 is driven by a motor 36 to rotate. An oil supply passage 34 extends through the shaft 32, as known. A downwardly extending boss 38 from the orbiting scroll is received on an eccentric pin from the shaft 32. A passage 40 extends radially outwardly through the base of the orbiting scroll 32 to a downwardly extending port 42. The port 42 is positioned radially between the outer seal 26 and the coupling 30.

As shown in FIG. 2, the passage 40 extends to the port 42. A plug 46 closes the passage 40 at its radially outer end to ensure there is adequate pressure to drive sufficient oil through the port 42.

As shown in FIG. 3, the non-orbiting scroll 24 includes a pair of ports 50 and 52 to supply suction refrigerant to the compression chambers. While the present invention is usable with scroll compressors having a single port, it is particularly beneficial for scroll compressors having a pair of ports.

FIG. 4 shows the unique and inventive positioning of the passage 40 relative to the beginning point 54 of the scroll wrap 23. As shown, an angle B is defined between the end point 54 and the passage 40. Preferably, that angle B is between 0 and 90°. More preferably, the angle is between 25° and 60°. In a most preferred embodiment the angle is approximately 30°.

With the inventive positioning, the oil supplied to port 32 is at a location such that it is unlikely it will be supplied in undue amounts into either suction port 50 or 52. Rather, the oil will be supplied at a location such that it will adequately lubricate the couplings 30 and the seals 26 and 28, and yet will not deliver undue amounts of lubricant into the compression chambers.

In the prior art, the oil supply port was essentially positioned to be in the bottom left hand quadrant of this figure. In such positioning, there is the risk of oil being delivered into the compression chambers, as it will be upstream of the inlet into the compression chambers. This becomes particularly acute in a dual suction port compressor.

Although a preferred embodiment of this invention has been disclosed, a worker in this art would recognize that certain modifications would come within the scope of this invention. For that reason, the following claims should be studied to determine the true scope and content of this invention.

What is claimed is:

1. A scroll compressor comprising:

first and second scroll members each having a base and a generally spiral wrap extending from said base;

a shaft for causing said second scroll member to orbit, said shaft being driven to rotate by an electric motor;

a coupling positioned within said scroll compressor to constrain said second scroll member to orbit;

a crankcase supporting said second scroll member, said crankcase having at least one seal for defining a back pressure chamber between an end face of said crankcase and a rear of said base of said second scroll member; and an oil supply passage extending radially outwardly through said base of said second scroll member to an oil supply port extending downwardly through said base toward said crankcase, said oil supply port being positioned radially between said seal and said coupling, and said oil supply passage being positioned in a downstream direction from an outer end of said wrap of said second scroll member by an angle of between 0 and 90°.

2. A scroll compressor as recited in claim 1, wherein said angle is between said 25° and 60°.

3. A scroll compressor as recited in claim 2, wherein said angle is 30°.

4. A scroll compressor as recited in claim 1, wherein said cross-passage is plugged at a radially outer location to ensure sufficient pressure to drive lubricant through said oil supply hole.

5. A scroll compressor as recited in claim 1, wherein there are a pair of suction passages leading into compression chambers defined between said first and second scroll members.

6. A scroll compressor as recited in claim 5, wherein said suction passages are formed through said first scroll member.

7. A scroll compressor comprising:

first and second scroll members each having a base and a generally spiral wrap extending from said base, said wraps of said first and second scroll members defining compression chambers, and there being a pair of suction ports extending through said first scroll member for defining said suction ports;

a shaft for causing said second scroll member to orbit, said shaft being driven to rotate by an electric motor;

a coupling positioned within said scroll compressor to constrain said second scroll member to orbit;

a crankcase supporting said second scroll member, said crankcase having at least one seal for defining a back pressure chamber between an end face of said crankcase and a rear of said base of said second scroll member; and an oil supply passage extending radially outwardly through said base of said second scroll member to an oil supply port extending downwardly through said base toward said crankcase, said oil supply port being positioned radially between said seal and said coupling, and said oil supply passage being positioned in a downstream direction from an outer end of said wrap of said second scroll member by an angle of between 25 and 60°.

* * * * *

UNITED STATES PATENT AND TRADEMARK OFFICE

CERTIFICATE OF CORRECTION

PATENT NO. : 6,375,444 B1
DATED : April 23, 2002
INVENTOR(S) : Dewar

It is certified that error appears in the above-identified patent and that said Letters Patent is hereby corrected as shown below:

Title page,
Item [73], "Assignee: Scroll Technologies, Arkadelphia, AK (US)" should be replaced with -- [73] Assignee: Scroll Technologies, Arkadelphia, AR (US) --

Signed and Sealed this

Seventeenth Day of September, 2002

*Attest:*

*Attesting Officer*

JAMES E. ROGAN
*Director of the United States Patent and Trademark Office*